United States Patent [19]

Grasso

[11] 4,368,777

[45] Jan. 18, 1983

[54] GAS-LIQUID HEAT EXCHANGER

[75] Inventor: Giacomo Grasso, Moncalieri, Italy

[73] Assignee: Centro Ricerche Fiat S.p.A., Turin, Italy

[21] Appl. No.: 233,258

[22] Filed: Feb. 10, 1981

[30] Foreign Application Priority Data

Feb. 18, 1980 [IT] Italy ..... 67242 A/80

[51] Int. Cl.[3] ..... F28D 7/10

[52] U.S. Cl. ..... 165/154; 165/146

[58] Field of Search ..... 165/146, 154, 183

[56] References Cited

U.S. PATENT DOCUMENTS

| | | | |
|---|---|---|---|
| 2,053,037 | 9/1936 | Lintern | 165/154 X |
| 2,276,527 | 3/1942 | Throckmorton et al. | 165/146 |
| 2,386,746 | 10/1945 | Hess | 165/154 |
| 3,022,982 | 2/1962 | Demalander | 165/146 |
| 3,346,042 | 10/1967 | Seehausen | 165/154 |
| 3,739,841 | 6/1973 | Small et al. | 165/146 |

FOREIGN PATENT DOCUMENTS

| | | | |
|---|---|---|---|
| 243761 | 3/1963 | Australia | 165/154 |
| 455710 | 1/1928 | Fed. Rep. of Germany | 165/146 |
| 679600 | 7/1939 | Fed. Rep. of Germany | 165/146 |
| 338588 | 7/1959 | Switzerland | 165/146 |
| 536 of 1857 | | United Kingdom | 165/154 |

*Primary Examiner*—Sheldon J. Richter

*Attorney, Agent, or Firm*—Sughrue, Mion, Zinn, Macpeak & Seas

[57] ABSTRACT

The characteristics of a gas-liquid heat exchanger are described, for particular use in the production of hot or superheated water by means of the exhaust gases emitted through the chimneys of a thermal treatment furnace, comprising an internal tubular element, for the passage of the gases, surrounded by an external tubular element which defines an annular chamber through which a liquid flows in counter-current to the flow of the gases in the internal tubular element. The latter is provided on its external surface and on its internal surface with radial fins, angularly equidistant from each other, extending axially for a substantial portion of the length of the internal tubular element. The height of each radial fin decreases linearly, both on the side exposed to the gas, and on the side exposed to the liquid, in the opposite direction to that of the flow of the fluid intended to come into contact with the fin, so as to enhance the heat exchange, while the same time avoiding damage through overheating of the said fin and of the wall of the internal tubular element.

1 Claim, 3 Drawing Figures

GAS-LIQUID HEAT EXCHANGER

The present invention relates to a gas-liquid heat exchanger of the compact type, which may be installed in an exhaust chimney for the hot gases emitted by a thermal treatment furnace. In particular, the invention relates to a heat exchanger which may be used for the production of hot or superheated water through the cooling of the exhaust gases emitted by a thermal treatment furnace, of the type comprising an internal tubular element for the passage of the gases and an external tubular element coaxially surrounding the internal tubular element, so as to define an annular chamber.

Water-hot gas heat exchangers which have been used hitherto are generally characterised by bundles of tubes, smooth or finned, sometimes leading to header plates, with far from negligible pressure losses both on the hot gas side and on the water side. Furthermore, these are so cumbersome that they do not lend themselves to being easily installed on a "continuous" or "bell-shaped" thermal treatment furnace which, however modest it may be, would not have less than 14–20 chimneys for the emission of the hot gases.

In view of the fact that a high working temperature in the heat exchanger, and, therefore, in this case, a high increase in temperature between the fluids involved, makes it possible in general to reduce the exchange surface, the characteristics of the known exchangers of the type specified above have until now led to the choice of refractory or special materials for their construction. Indeed this is necessary to achieve a high degree of reliability of the heat exchanger, since any breakdown might involve, in some cases, heavy losses in production.

One of the problems from which the present invention stems is that of providing a heat exchanger which does not require the use of materials with particular characteristics of resistance to thermal stresses, such as, for example, alloy steels. These materials beside having, in some cases, characteristics which make the processing less economical, lead to the production of heat exchangers which, for the same thermal efficiency, are more cumbersome and have higher pressure losses both on the hot gas side and on the water side.

In terms of design, the internal tubular member has its dimensions based on the current calculation standards (for example ASME standards), treated as if it were a simple cylinder subjected to pressure from the exterior towards the interior. The external tubular element is similarly considered to be subjected to stress from the inside towards the outside.

The object of the present invention is to provide a gas-liquid heat exchanger of the type specified above which has, on the one hand, an efficient exchange surface and which, on the other hand, is compact and less cumbersome, with pressure losses which are almost nil on the hot gas side and reduced to low levels on the water side.

A further object of the present invention is to provide a gas-liquid heat exchanger of the type specified above which is of simple and economical construction, due to the use of a low cost material (for example carbon steel).

A further object of the present invention is to provide a gas-liquid heat exchanger of the type specified above which may be fitted directly onto the chimneys of thermal treatment furnaces without modifying their existing structure and in particular without increasing the space occupied by the chimney for the discharge of the hot gases. The internal tubular member of the heat exchanger may in fact be used as a section of the chimney for the discharge of the gases, whilst the annular chamber delimited by the external tubular member, in which the water circulates, causes a slight increase in the space occupied by the chimney.

In order to achieve the aforesaid objects, the present invention provides a gas-liquid heat exchanger of the type specified above, characterised by the following combination of characteristics:

(a) the annular chamber is intended to be traversed by the fluid to be heated in counter-current to the flow of the gases in the internal tubular element, (b) the internal tubular element is provided on its external surface and on its internal surface with a plurality of radial fins, angularly equidistant from each other, each of which extends parallel to the internal tubular element for a substantial portion of the length of the latter, (c) each radial fin has a radial height decreasing linearly in the opposite direction to that of the flow of the fluid intended to come into contact with the fin.

In the heat exchanger according to the present invention, the variation of the radial height of each fin along the axis of the exchanger is selected so as to produce the optimal exchange surface to achieve a predetermined overall co-efficient of heat transfer between gas and liquid.

In this manner a sufficient heat exchanger is ensured in correspondence with the wall of the tubular element, at the same time satisfying the need to keep the radial extent of the fin as small as possible, the latter being relatively thin and therefore prone to the danger of damage through overheating due to the contact with the hot fluid.

Account is taken of the fact that the heat transfer occurs by convection and, to an appreciable degree, also through radiation, due to the high temperatures of the gases which pass through the internal tube used as the exhaust chimney for the gases.

Indicating by dL a portion of the length of the tube, by dq the quantity of heat transferred in correspondence with this portion, by $\alpha_L$ the coefficient of transmission per unit of length (Kcal/mh°C.), and by $\Delta t$ the average increase in temperature, the following relation applies:

$$\frac{dq}{\alpha_L \Delta t} = \int dL$$

A further advantage of the heat exchanger according to the invention lies in the fact that, since the formation of vortices is not favoured, either in the heating gas or in the heated fluid, the pressure loss on the gas side is almost nil and the pressure loss on the water side is very limited.

The present invention will now be described with reference to the accompanying drawings, supplied purely by way of non-limitative example, in which.

Figure 3:
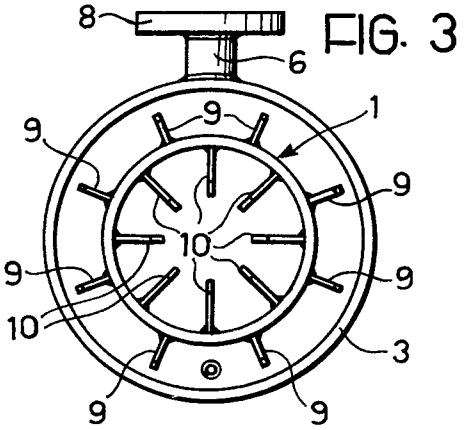
FIG. 3 is a section taken along the line III—III of FIG. 2.
Figure 2:
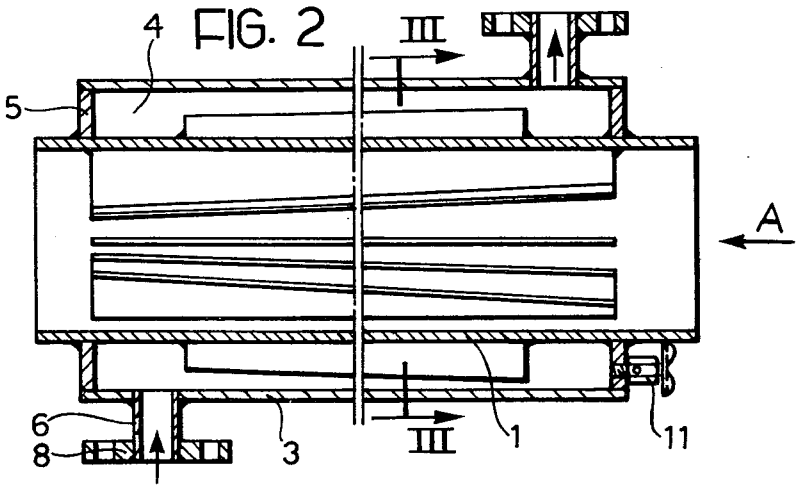
FIG. 2 is a section taken along the line II—II of FIG. 1.
Figure 1:
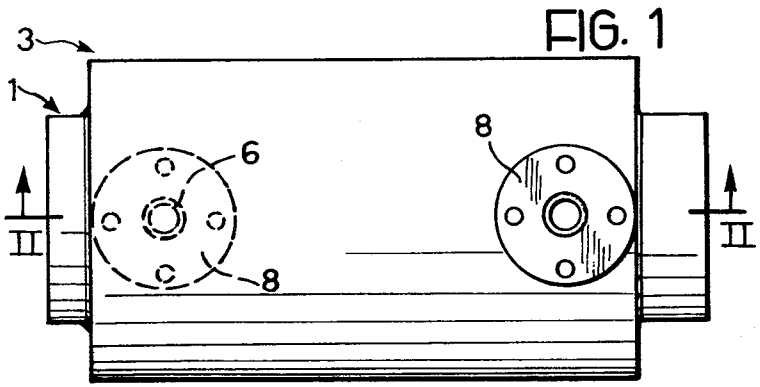
FIG. 1 is a side view of a heat exchanger according to the invention.

The heat exchanger according to the invention comprises an internal tubular element 1 intended to be traversed in the direction of the arrow A of FIG. 2 by the exhaust gases emitted by a thermal treatment furnace.

An external tubular element 3 surrounds the internal tubular element 1 coaxially so as to define an annular chamber 4 delimited at its ends by two annular elements 5 secured by means of welding to the internal surface of the tubular element 3 and to the external surface of the tubular element 1. The annular chamber 4 is intended to be traversed by a flow of water in the opposite direction to the flow of the exhaust gases inside the tubular member 1. References 6,7 indicate respectively connections for the flow of water into and out of the annular chamber 4, each connection being provided with an annular connection flange 8.

A plurality of radial fins 9,10 are secured by means of welding to the external surface and to the internal surface respectively of the internal tubular element 1. The fins 9,10 are angularly equidistant from each other. Furthermore each of the fins 9 projecting from the external surface of the tubular element 1 has an angular position intermediate between the two fins 10 adjacent to it which project from the internal surface of the tubular element 1.

Both the radial fins 9 and the radial fins 10 extend parallel to the axis of the tubular element 1 for a substantial portion of the length of the latter.

Each of the radial fins has, moreover, a radial height decreasing linearly in the opposite direction to that of the flow of fluid intended to come into contact with the fin. This means that the radial fins 9 projecting from the external surface of the tubular element 1 have a height decreasing from their end adjacent the outlet connection 7 in the direction of the opposite end adjacent the connection 8 for the inlet of water into the heat exchanger, whilst the radial fins 10 projecting from the internal surface of the tubular member 1 have a height decreasing from their end adjacent the end of the tubular element 1 used for the outlet of the exhaust gases from the heat exchanger (i.e. the end of the left in FIG. 2) in the direction of their opposite end.

In this manner, each of the radial fins 10 has, in correspondence with the inlet of the exhaust gases into the heat exchanger, that is, in correspondence with the zone of higher temperature during operation, a reduced height: this is to avoid overheating and, therefore, damage through the effect of contact with the gas at high temperature. Similarly, the height in the radial direction of each fin 9 is smaller adjacent to the inlet connection 6, where the temperature of the water during operation is higher.

The radial height of each of the fins 9,10 in correspondence with a general transverse section of the heat exchanger is selected so as to achieve a compromise between the need to obtain a sufficient exchange surface and the need to prevent the fin from being exposed to the risk of overheating and damage.

By 11 in FIG. 2 is indicated a tap for the drainage of water which may possibly remain on the bottom of the annular chamber 4.

I claim:

1. Gas-liquid heat exchanger particularly for the production of hot or superheated water by means of exhaust gases emitted by a thermal treatment furnace, comprising an internal tubular element for the passage of the gases and an external tubular element coaxially surrounding the internal tubular element so as to define an annular chamber, characterized by the following combination of characteristics:

(a) the annular chamber is intended to be traversed by the liquid to be heated in counter-current to the flow of the gases in the internal tubular element, (b) the internal tubular element is provided on its external surface and on tis internal surface with a plurality of radial fins, angularly equidistant from each other, each of which extends parallel to the axis of the internal tubular element for a substantial portion of the length of the latter, (c) each radial fin has a radial height decreasing linearly in the opposite direction to that of the flow of the fluid intended to come into contact with the fin, and (d) each of the radial fins which projects from the external surface of the internal tubular element is arranged in an angular position intermediate the two radial fins adjacent to it which project from the internal surface of the internal tubular element.

* * * * *